United States Patent [19]

Grauso

[11] 4,334,458

[45] Jun. 15, 1982

[54] SUSPENSION BAND DRUM

[76] Inventor: Robert N. Grauso, R.D. 1, Mountain Ave., Pen Argyl, Pa. 18072

[21] Appl. No.: 236,393

[22] Filed: Feb. 20, 1981

[51] Int. Cl.[3] ..... G10D 13/02

[52] U.S. Cl. ..... 84/411 R; 84/413

[58] Field of Search ..... 84/411 R, 411 A, 411 M, 84/413, 415

[56] References Cited

U.S. PATENT DOCUMENTS

| | | | |
|---|---|---|---|
| 37,570 | 2/1863 | Dermond | 84/413 |
| 274,900 | 4/1883 | Boulanger . | |
| 371,415 | 10/1887 | Boulanger | 84/411 R |
| 519,914 | 5/1894 | Koeth . | |
| 830,952 | 9/1906 | Zoeller | 84/411 R |
| 1,284,526 | 11/1918 | Winne . | |
| 1,334,334 | 3/1920 | Wanamaker . | |
| 1,420,233 | 6/1922 | Baldwin et al. . | |
| 1,995,066 | 3/1935 | Hiers | 84/411 R |
| 2,548,271 | 4/1951 | Percy . | |
| 3,019,685 | 2/1962 | Davis . | |
| 3,136,201 | 6/1964 | Lang et al. | 84/411 R |
| 3,185,013 | 5/1965 | Gussak | 84/411 R |
| 3,435,723 | 4/1969 | Corder . | |
| 3,439,573 | 4/1969 | Zottolo . | |
| 3,533,324 | 10/1970 | Price . | |
| 3,635,119 | 1/1972 | Thompson . | |
| 3,647,931 | 3/1972 | Koishikawa . | |
| 3,724,313 | 4/1973 | Frigo et al. . | |
| 3,865,003 | 2/1975 | Della-Porta . | |
| 3,911,779 | 10/1975 | Della-Porta . | |
| 4,122,747 | 10/1978 | Yamashita . | |
| 4,158,980 | 6/1979 | Gauger . | |
| 4,295,405 | 10/1981 | Sleishman | 84/411 R |

FOREIGN PATENT DOCUMENTS

| | | |
|---|---|---|
| 238479 | 5/1962 | Australia . |
| 48242 | 1/1979 | Australia . |
| 697976 | 9/1940 | Fed. Rep. of Germany . |

OTHER PUBLICATIONS

Urban, Andrew L., American Modern Drummer, "Percussion Innovations from Down Under", Encore Magazine, Oct./Nov. 1980, pp. 20–21 & 78.

"Don Sleishman's Newest Invention", Encore Magazine, Oct. 1979, pp. 3–7.

*Primary Examiner*—Lawrence R. Franklin

*Attorney, Agent, or Firm*—Seidel, Gonda, Goldhammer and Panitch

[57] ABSTRACT

A suspension band musical drum system is provided allowing for the free vibration of the shell in response to vibrations from the drum head. A suspension band encircling the drum shell connects the hoops holding the drum heads in place without necessitating any piercing of the drum shell. The suspension band has a spacer ring attached to its inner surface. The spacer ring engages a slotted channel in the drum shell.

13 Claims, 4 Drawing Figures

FIG. 1
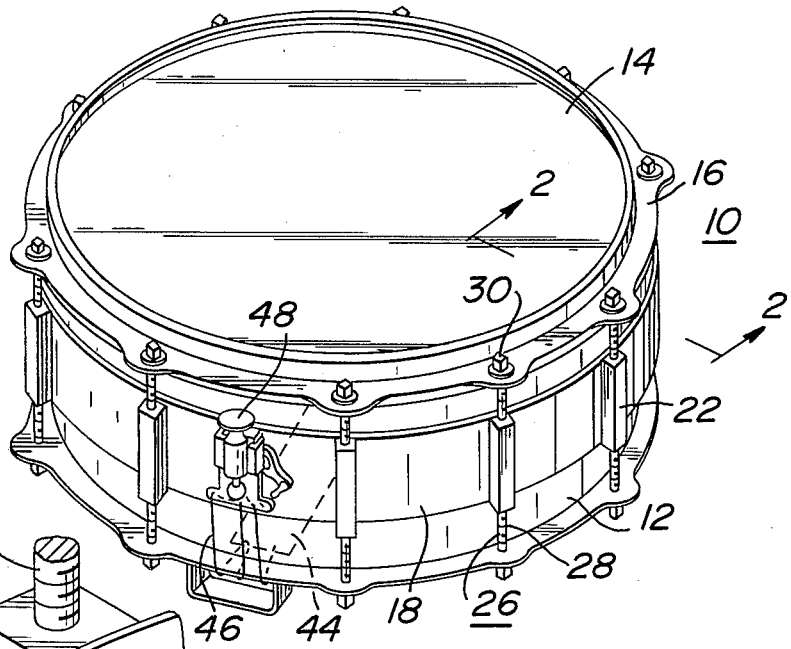
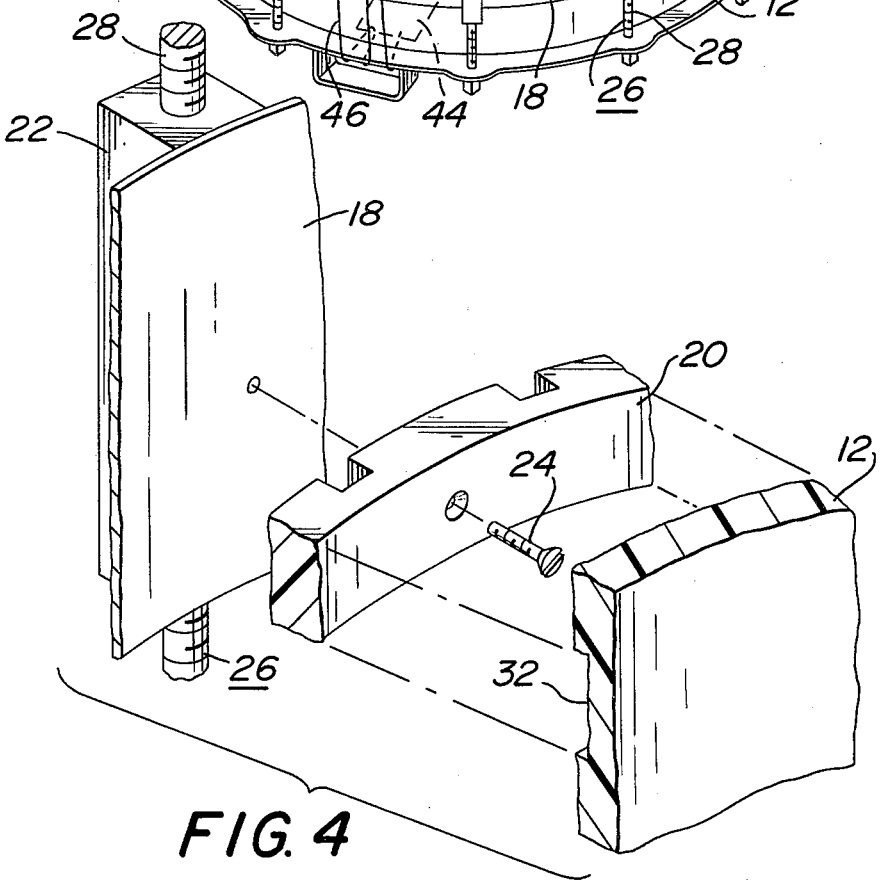
FIG. 4

SUSPENSION BAND DRUM

BACKGROUND OF THE INVENTION

This invention relates to a musical drum. More particularly, the present invention concerns the employment of a suspension band around the drum shell so as to hold the drum skin tautly in place without piercing the drum shell and thus allowing the shell to vibrate freely.

Musical drums are percussion instruments found in numerous varieties the world over and since the earliest times. Drums have been known to exist in the most primitive tribes of Africa and South America as well as in China, India and Arabia. A large bass drum was depicted on a Sumerian vase of the third millennium B.C. Egyptian drums dating back to 1800 B.C. have been discovered and drums were mentioned in Chinese poems of 1135 B.C.

A conventional musical drum generally consists of two heads (diaphragms or skins) mounted on a cylindrical body. This construction allows the vibrations on one head to be transferred through the air inside the drum shell to the other head and cause such other head also to vibrate. The drum heads or skins are held in place over the ends of the drum shell by drum hoops or rims.

Turning screws, generally six or eight in number, pass through apertures in each drum rim and are screwed into fixed brackets which are mounted at uniformly spaced positions around the drum shell. Tuning of the drum is accomplished by turning the screws into the brackets. This operation serves to draw the drum rim down over the end of the drum shell, thereby applying tension to the drum skin, which is thus stretched over the end of the drum shell. This tuning operation normally occupies some considerable time since each individual tuning screw must be individually turned until the desired pitch or tune is attained.

Some drum varieties consist of only one head, for example, the bongo, the timpani and some bass drums. Other drum varieties include the kettle drum, the dawul, the side drum, the tenor drum and the snare drum, just to mention a few. The snare drum has wires stretched across one of the heads; these wires beat against the head when it vibrates and produce high frequency vibrations that add more noise to the sound of the drum.

In most conventional drum systems, the drum hoops which hold the drum heads in place are connected to the drum shell by direct physical attachment. This attachment generally involves piercing, i.e., drilling holes into, the drum shell at numerous points. This is illustrated in many U.S. patents such as U.S. Pat. Nos. 274,900; 1,284,526; 1,334,334; 1,420,233; 2,548,271; 3,019,685; 3,435,723; 3,439,573; 3,533,324; 3,647,931; 3,724,313 and 3,911,779.

The main source of noise from a conventional drum is the vibration of the drum head as a result of being struck by a drumstick or the like and the sympathetic induced vibration in the diametrically opposed drum head. Ignored in the design of conventional drum systems is the utilization of the shell as a source of residual vibration to add to the tone and output of the drum if the shell were to be allowed to freely vibrate. The aforementioned direct physical attachment of the drum hoops to the shell serves to dampen and eliminate shell vibration.

U.S. Pat. No. 519,914 describes the use of a ring B surrounding drum shell A. There is no provision, however, for spacing the ring away from the drum shell to form a suspended shell. Likewise, U.S. Pat. No. 1,284,526 discloses the use of an adjustable band surrounding the drum shell that also does not form a suspended shell.

A drum having window openings in the shell is described in U.S. Pat. No. 3,136,201. Also internal means within the shell serve as a sounding board responsive to sound waves from the vibrating drum head (auxiliary sound reproducing member) to radiate sound waves through the windows in the shell.

U.S. Pat. No. 3,439,573 relates to a drum design utilizing two shells, one for assembly of fittings and the other shell as a resonator (placed inside the outer shell). The resonator is essentially a floating sound chamber. However, the resonator shell does not support either head—thus acting as a sound deflector rather than a sound transmitter.

A snare drum having a tapered and flanged cast metal shell and a cast strainer mounting means is described in U.S. Pat. No. 3,635,119. This drum design does not allow for the suspension of the drum shell.

A snare drum having a body shell made up of two complementary half shells is disclosed in U.S. Pat. No. 3,865,003.

U.S. Pat. No. 4,122,747 is directed to a lug assembly for anchoring drum heads to the drum shell.

Australian Patent Specification No. 50,942/59 relates to a ring adapted to secure the drum skin to the drum shell.

Australian Patent Specification No. 48,242/79 of Donald Sleishman (U.S. patent application Ser. No. 082,462) concerns a musical drum in which the loading means attaching the drum skin to the drum shell is connected to the shell at various points on the inner surface of the shell, rather than directly attached to the outer surface of the shell. Sleishman's drum design requires, however, the piercing of the drum shell (by drilling holes in the shell) as is clearly shown in FIGS. 3, 4 and 6.

Heretofore, no drum design provided for a truly suspended drum shell. It would be quite advantageous to have a drum shell freely suspended and without piercing of the drum shell so as to provide enhanced sound emanating from the musical drum.

SUMMARY OF THE INVENTION

There has now been discovered a musical drum employing a suspension drum shell system which eliminates the need for holes or fasteners through the drum shell. The shell is suspended to vibrate freely to create greater tonal response and sound projection. Previous drum designs required the drilling of the shell to mount the lugs and associated assemblies for the normal operation of playing or tuning a drum. The piercing of the drum shell interfered with the ability of the shell to respond to the vibrating drum head.

The present invention involves a musical drum composed of a body shell having an open end at the top and body thereof and having an inner and outer circumferential surface. The shell has a slotted channel on its outer circumferential surface. Drum heads are disposed over the ends of the shell. Hoops are placed circumferentially around the drum heads. A spacer ring of a rigid, flexible material is disposed within the channel on the drum shell. A suspension band having an inner and outer circumferential surface encircles the spacer ring. The suspension band contains clamping means positioned on the outer circumferential surface of the suspension band. The clamping means attach the hoops to the band so as to tautly maintain the drum heads on the shell without requiring the piercing of the drum shell.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a perspective view showing the entire drum system of the present invention.

FIG. 4 is a vertical sectional view of the suspension band section of this invention in a disassembled condition.

DETAILED DESCRIPTION OF THE INVENTION

Figure 2:
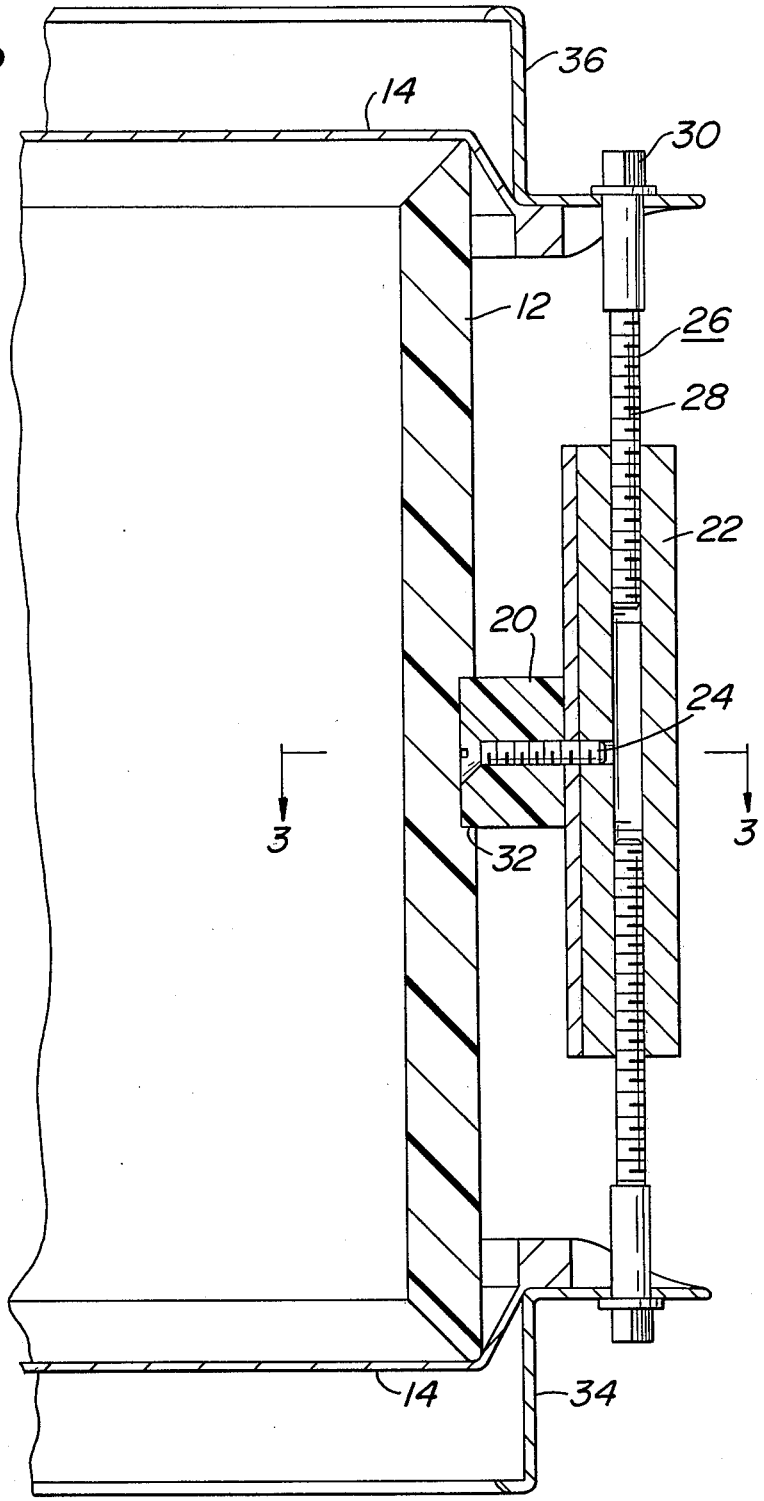
FIG. 2 is a vertical sectional view taken of the suspension band section of the invention along lines 2—2 of FIG. 1.
Figure 3:
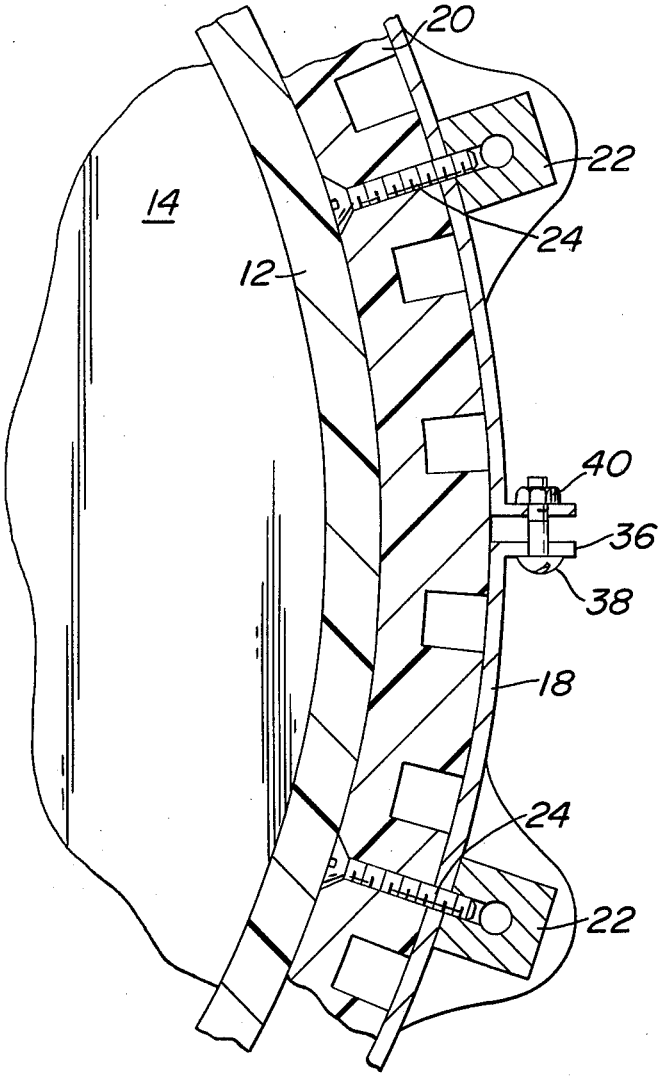
FIG. 3 is a top sectional view of the suspension band section of the present invention.

Referring to the drawings, in all of which like parts are designated by like reference numerals, the musical drum 10 of the present invention is shown. The drum 10 is a drum shell 12 formed of any conventional material such as wood; plastic, for example, fiberglass; and metal, for example, cast aluminum. The drum shell 12 is generally cylindrical in shape. Drum heads 14 are disposed over both the top and bottom end of the shell 12. The heads 14 are generally composed of animal skin or a plastic material, for example, polyvinylchloride or polyethylene teraphthalate ("MYLAR"), etc. The drum heads 14 are held in place by hoops 16 disposed circumferentially around the head 14.

A suspension band 18 encircles the outer surface of the shell 12 at approximately midway between the top and bottom of the shell 12. The suspension band 18 is attached to the hoops 16 by a bolt assembly clamping means 26.

The bolt assembly clamping means 26 is composed of a plurality of lugs 22 which are disposed longitudinally on the outer surface of the suspension band 18 at various positions around the band 18. It is preferred that the lugs 22 be approximately equidistant apart. The number of lugs 22 can range from between about four and sixteen with ten lugs 22 being preferred.

Each lug 22 has a generally centrally positioned bore which houses a tension bolt 28. The tension bolt 28 is secured to the hoops by tension nut 30. The preferred material of construction for the suspension band 18 and for the various parts of the bolt assembly clamping means 26 is metal, although plastic can also be used for the tension bolts 28 and the tension nuts 30.

A spacer ring 20 is fastened to the inner surface of suspension band 18. It is preferred that the spacer ring 20 be fastened to the band 18 at each lug position. The spacer ring 20 in such case is connected to the lug 22 by a spacer ring-lug screw 24. When the suspension band 18 is placed around the drum shell 12, the spacer ring 20 is thus situated between the suspension band 18 and the shell 12.

A channel 32 is slotted out of the outer surface of the shell 12 and extends around the entire circumference. The channel 12 is of such dimension so as to accommodate the spacer ring 20. The channel 32 is located approximately midway between the ends of the shell 12. When the suspension band 18 is clamped around the drum shell 12, the spacer ring 20 is positioned around the circumference of the drum shell 12 and disposed within the channel 32. The spacer ring 20 is constructed from a relatively rigid, flexible material such as a plastic.

In a typical size drum, for example, a drum shell 14 inches in diameter and 5 inches in vertical length, the channel 32 is approximately 7/16 inch wide and 1/16 inch deep. The plastic spacer ring 20 may be longitudinally slotted in order to allow it to be bent around the drum shell. When the spacer ring 20 is slotted, the spacer ring 20 is positioned such that the slots generally face the suspension band 18. The slots of the spacer ring 20 can also face the channel 32.

The suspension band 18 is held in place by angle clamp 36, clamp screw 38 and clamp nut 40. When the clamp screw 38 is tightened into the clamp nut 40 through the angle clamp 36, the band 12 is drawn closed. The closing of the angle clamp 36 applies horizontal pressure to the spacer ring 20. The spacer ring 20 serves to suspend the shell.

Only sufficient horizontal pressure is required to maintain the band 12 in a fixed position. Excessive vertical tensioning of the bolt assembly clamping means 26 is not required. Vertical tension must only be such as to maintain the heads 14 in a taut condition. Vertical tensioning is also used to tune the drum heads. A drummer can adjust the vertical tensioning at each lug position and thus control the tuning on the top and bottom heads independently.

Generally, any type drum can be suspended in accordance with the present invention. In the Figures, a snare drum is depicted. Drum snares 44 are attached to snare suspension strings 46. The snare suspension strings 46 are connected at one side to strainer mechanism 48 which is fastened to the suspension band 18. The snare suspension strings 46 are connected to the suspension band 18 at the diametrically opposed side by a clamp mechanism (not shown).

The present invention may be embodied in other specific forms without departing from the spirit or essentrial attributes thereof and, accordingly, reference should be made to the appended claims, rather than to the foregoing specification, as indicating the scope of the invention.

I claim:

1. A musical drum which comprises:

(a) a body shell having an open end at top and bottom and having inner and outer circumferential surfaces, said shell having a slotted channel on the outer circumferential surface of said shell, (b) heads disposed over said open ends of said shell, (c) hoops disposed circumferentially around said heads, (d) a spacer ring of a rigid, flexible material disposed within said slotted channel, (e) a suspension band having an inner and outer circumferential surface, said band encircling said spacer ring, said suspension band comprising clamping means positioned on the outer circumferential surface of said suspension band attaching said hoops to said suspension band so as to tautly maintain said heads on said shell without requiring any piercing of said shell.

2. A musical drum of claim 1 wherein said shell is cylindrical in shape.

3. A musical drum of claim 1 wherein said spacer ring is constructed from plastic.

4. A musical drum of claim 3 wherein said plastic spacer ring has a plurality of longitudinal slots, said ring positioned such that said slots face said band.

5. A musical drum of claim 1 wherein said clamping means comprises a plurality of lugs disposed longitudinally on the outer surface of said band with a bolt assembly associated with each lug, said bolt assembly positioned within a generally centrally located bore in said lug and engaging said hoops.

6. The musical drum of claim 5 wherein said lugs are generally uniformly located around said band.

7. A musical drum of claim 5 wherein there are between about four and about sixteen lugs.

8. The musical drum of claim 1 wherein said drum is a snare drum.

9. The musical drum of claim 1 wherein said suspension band is fastened around said shell by clamping means.

10. A musical drum of claim 9 wherein said clamping means is a screw and nut combination.

11. The musical drum of claim 1 wherein said spacer ring is fastened to said suspension band.

12. The musical drum of claim 11 wherein said fastening of said ring to said band occurs at each lug.

13. The musical drum of claim 1 wherein said channel is located approximately in between said ends of said shell.

* * * * *